United States Patent [19]

Johnson et al.

[11] 4,378,555

[45] Mar. 29, 1983

[54] METHOD AND APPARATUS FOR MONITORING UNBURNED PARTICULATE ACCUMULATION IN THE EXHAUST DUCT OF A COMBUSTION SYSTEM

[76] Inventors: Thomas A. Johnson, 220 Kenwood, Ann Arbor, Mich. 48103; Donald R. Demorest, 813 Westwood, Fenton, Mich. 48430; Michael J. Thielemans, 23612 Londonderry, Novi, Mich. 48050

[21] Appl. No.: 306,023

[22] Filed: Sep. 28, 1981

[51] Int. Cl.[3] ..... G08B 21/00; G08B 29/00

[52] U.S. Cl. ..... 340/588; 110/193; 169/65; 340/309.15

[58] Field of Search ..... 340/588, 309.1; 169/45, 169/54, 65; 110/190, 193

[56] References Cited

U.S. PATENT DOCUMENTS

| | | | |
|---|---|---|---|
| 3,186,228 | 6/1965 | Lever et al. | 340/588 |
| 3,931,619 | 1/1976 | Moore et al. | 340/588 |
| 4,315,296 | 2/1982 | Hancock | 340/588 |
| 4,341,267 | 7/1982 | Lagasse | 169/54 |

*Primary Examiner*—Glen R. Swann, III

*Attorney, Agent, or Firm*—Krass, Young & Schivley

[57] ABSTRACT

The unburned particulate accumulation within the exhaust for a combustion system, such as the liner of a flue for a stove, is monitored by a circuit which receives a temperature indicating signal from a thermo couple mounted within the flue. The circuit includes comparators which process the temperature signal to determine whether the temperature is within in any of three ranges. When the temperature is within a normal burning range, the elapsed time that the temperature remains within such range is stored as a first count whose magnitude is proportional to the accumulation of particulates. When the first count exceeds a prescribed level, a warning device is activated. When the temperature reaches a higher cleaning range that is sufficient to burn the accumulated particulates, the elapsed time that the temperature remains within such range is stored in a second counter. The first counter is reset when the value of the second counter reaches a prescribed value.

25 Claims, 4 Drawing Figures

18
10
42
30
32
POWER
HOT FIRE
YELLOW TEST
OPERATE
FLUE NEEDS CLEANING
RED TEST
12
14
20
22
34
40
44
36
16
24
30

FROM MAIN CIRCUIT
LOW TEMP TIMER
Q20
Q12
REG
REG
+V
-V

METHOD AND APPARATUS FOR MONITORING UNBURNED PARTICULATE ACCUMULATION IN THE EXHAUST DUCT OF A COMBUSTION SYSTEM

TECHNICAL FIELD

The present invention generally relates to combustion monitoring systems, and deals more particularly with a device implemented method for monitoring the accumulation of unburned particulates in an exhaust duct employed to exhaust combustion gases from combustion system.

BACKGROUND ART

Many combustion devices, such as stoves, fireplaces, and internal combustion systems burn fuels that generate unburned particulate matter which is carried by hot exhaust gases through an exhaust duct into the atmosphere. A portion of the unburned particulates normally condense on the lining of the exhaust duct to form a coating of the unburned particulates. The accumulation of unburned particulates on the exhaust duct is particularly acute in a so called air tight combustion system in which the oxygen available to facilitate combustion is minimized. In the case of stoves or fireplaces which burn solid fuels, this accumulation of unburned particulates is in the form of a creosote coating.

A substantial accumulation of unburned particulates on an exhaust duct presents a definite fire hazard, as those skilled in the art have long recognized. In order to avoid such fire hazard, it has been necessary in the past to either manually "sweep" the unburned particulates from the exhaust duct on a relatively regular basis, or burn the accumulated particulates by generating a particularly hot fire in the combustion chamber. Both of these approaches are effective for removing the unburned particulates; however, it has been heretofore impossible to determine specifically when the unburned particulates have accumulated on the exhaust duct to a dangerous level. Thus, in order to assure that a fire hazard was avoided exhaust ducts were cleaned more often then necessary, thereby resulting in wasted effort and energy resources. In some cases, particulates are no doubt allowed to accumulate beyond a hazardous level, thus posing a risk of loss of life or property.

It is therefore a primary object of the present invention to overcome each of the deficiencies mentioned above and to provide a method and apparatus for monitoring the accumulation of unburned particulates on the exhaust duct associated with a combustion system.

Another object of the invention is to provide a monitoring system of the type mentioned above which provides a visual or audible warning when the particulates have accumulated to a potentially hazardous level.

A still further object of the invention is to provide a monitoring system as described above which is capable of monitoring dissipation of accumulated unburned particulates which are burned by a particularly hot fire in the associated combustion apparatus.

These and further objects of the invention will be made clear or will become apparent during the course of the following description of a preferred embodiment of the invention.

DISCLOSURE OF THE INVENTION

The unburned particulate accumulation in the exhaust duct of a combustion system, such as the flue lining of a stove, is monitored by a circuit which receives a temperature indicating signal from a temperature sensing device mounted within the duct. The sensing device preferably comprises a thermocouple which produces an electrical analog signal whose magnitude varies in proportion to the sensed temperature. The analog temperature signal is processed by a logic circuit to control the counting of digital pulses produced by a clock. When the temperature is within a normal operating range in which unburned particulates accumulate on the duct, the digital pulses are accumulated in a first counter, the value of which count corresponds to the duration of time that the sensed temperature remains within the normal operating range. Thus, the accumulated count is proportional to the mgnitude of accumulation of the unburned particulates. When the sensed temperature is within a higher range sufficient to result in combustion of the unburned accumulated particulates, the pulses are accumulated as a count in a second counter; the value of the count in the second counter is proportional to the continous length of time that the sensed temperature remains in the higher range. When the value of the counter reaches a prescribed value, which corresponds to the point at which substantially all the unburned particulates on the exhaust duct have been combusted, both the first and second counters are reset. In the event that the sensed temperature exceeds a dangerously high level, the circuit energizes an audible alarm.

BRIEF DESCRIPTION OF THE DRAWINGS

In the drawings, which form an integral part of the specification and are to be read in conjuncton therewith, and in which like references numerals are employed to designate identical components in the various views.

BEST MODE FOR CARRYING OUT THE INVENTION

Figure 1:
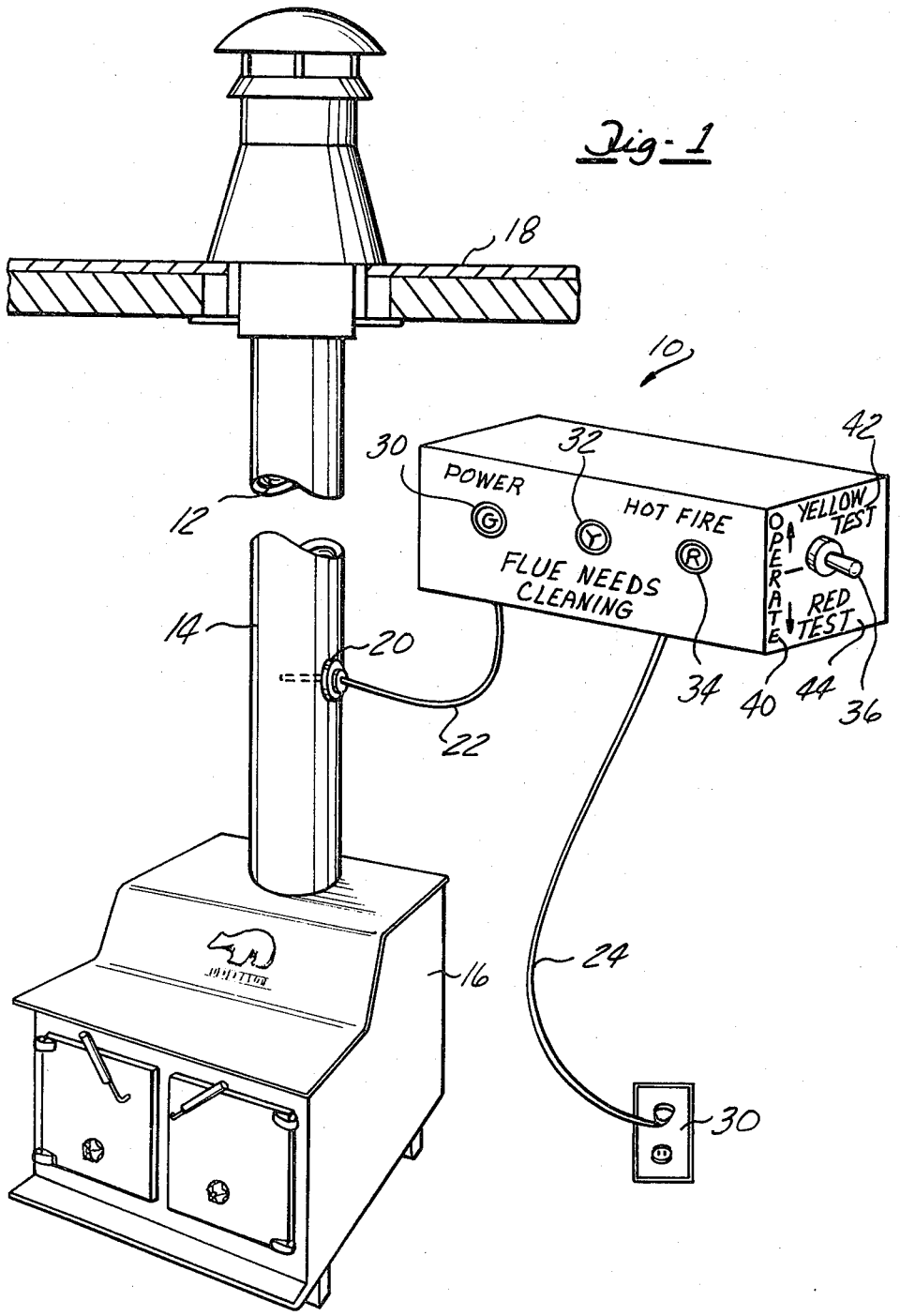
FIG. 1 is a perspective view of an apparatus for monitoring unburned particulate accumulation on the flue lining of a stove, which forms the preferred embodiment of the present invention, shown in operative relationship to a stove and flue lining.

Referring first to FIG. 1, the present invention is generally concerned with apparatus, broadly indicated by the numeral 10, for monitoring the accumulation of unburned particulates on or within the exhaust duct of a combustion system, such as the lining 12 of flue 14. Flue 14 is adapted to direct hot exhaust gases and unburned particulate matter from a combustion chamber of a stove 16 or the like upwardly through the roof 18 of a structure. Although a stove 16 and associated flue 14 are specifically discussed herein, for illustrative purposes it is to be understood that the invention may be effectively employed in other types of combustion systems, such as an internal combustion engine or the like.

It is well known that when heated to ignition temperature, cellulosic fuels such as wood evolve combustible and noncombustible gases as well as unburned particulates which form creosote. The ignition temperature for many dried cellulosic materials is between 400° and 500° F. At these temperatures, the unburned particulates are carried by hot combustion gases upwardly through the flue 14 and condense on the lining 12. The particulates and/or creosote formed on the lining 12 have an ignition temperature of about 420° F., consequently, the particulates accumulate on the lining 12 until the temperature within the flue 14 exceeds 420° F.

One function of the apparatus 10 is to monitor the time during which the temperature within the flue 14 is within a range corresponding to the normal operation temperature of the stove wherein unburned particulates accumulate on the liner 12. The temperature within the flue 14 is sensed by a temperature sensor 20 which preferably comprises a J-type thermocouple. The invention may best be appreciated by now providing a description of the operation of the monitoring apparatus 10, following which a detailed description of its construction will be provided. Basically, the monitoring device 10 provides a warning when the flue 14 requires cleaning of accumulated creosote on the lining 12 thereof before such accumulation poses a fire hazard. The device 10 also monitors hot fires in the stove 16 which burn and thereby eliminate the creosote buildup on the flue lining 12.

The device 10 includes a green power light 30, a yellow light 32 indicating that the flue 14 requires cleaning and a red light 34 which indicates that a "hot" fire is burning in the stove 16 which has a temperature sufficient to burn the accumulated creosote buildup in the flue 14. A three position switch 36 allows testing of the lights 30–34 to assure that the circuits are functioning properly.

The monitoring device 10 measures the duration of time during which the temperature in the flue 14 is within a range which results in the formation of particulates, i.e. creosote on the lining 12 of the flue 14. This temperature range is readily adjustable and may be, for example, between 150° F. and 350° F. Normally, the green light 30 is illuminated to indicate that the amount of creosote accumulated on the flue lining 12 is below a hazardous level. When, however, the flue temperature is within the creosote forming range for a prescribed length of time, the yellow light 32 is illuminated, thus indicating that the flue lining 12 needs cleaning. The stove user may then build a "hot" fire in the stove 16. The hot fire elevates the temperature within the flue 14 to a temperature sufficient to burn the accumulated creosote; this temperature may, for example, be between 600° and 1200° F. When the hot fire continues for a predetermined time interval, corresponding to the duration required to substantially cleanse flue 14 of accumulated creosote, the yellow light is deenergized, and remains deenergized until the creosote again accumulates to a hazardous level. In the event that the flue temperature is elevated to the cleansing temperature during normal operation of the stove 16 and remains so elevated at the cleansing temperature for the prescribed time interval, a timing circuit associated with the yellow light 32 is reset, even though the yellow light 32 has not been illuminated, as will be discussed later herein.

In the event that the flue temperature reaches a hazardous level posing a risk of the fire e.g. above 1200° F., a later discussed horn 38 or the like is energized to provide an audible warning of the danger.

The apparatus 10 is provided with a test switch 36 to test the circuitry and lights 30–34. When the switch 36 is held in the "yellow test" position 42, the yellow light 32 comes on within 2 seconds and stays on after the switch 36 is allowed to spring return to the "operate" position 40. When the switch 36 is held in the "red test" position 44, the red light 34 comes on, and, after 2 seconds, the yellow light 32 is extinquished. The red light 34 goes out when the switch 36 is released. This test sequence is similar to the normal operation of the lights 30–34 described above.

Reference is now also made to FIGS. **2*a* and 2*b* depicting a detailed schematic for the monitoring device 10. The temperature sensor 20, which may comprise a J-type thermocouple, has its outputs connected to the inputs of a zeroed, gain of 10 differential amplifier 46 which increases the signal level of the thermocouple output. The amplified thermocouple signal is filtered by means of resistor 48 and capacitor 50 and is delivered to the positive inputs of three comparators 52–56. The negative inputs of comparators (operational amplifiers) 52–56 are connected to corresponding potentiometers 58–62 which allow adjustment of the threshold values of the associated op-amp; the settings of potentiometers 58–62 correspond to particular temperature values sensed within the flue 14. Potentiometer 58 is set at the minimum operating temperature e.g. 150° F., which corresponds to the minimum temperature in the flue 14 at which burning can occur, while potentiometer 60 is set at the expected maximum for normal operating conditions. Potentiometer 62 is set to correspond to a temperature e.g. 600° F., above which creosote on the lining 12** undergoes combustion.

The output of op-amp 54 is delivered through an additional op-amp 64. The outputs of op-amps 52, 56, and 64 are processed by logic means comprising NAND gates 68 and 72, NOR gates 70 and 74 and a clock comprising NAND gates 76 and 78. The clock generates clock pulses at a desired frequency, which may be, by way of example 4 hertz. An output terminal 104 allows sampling the clock pulse rate. The logic means mentioned above deliver the outputs of op-amps 52 and 64 to the input of a low temperature timer generally indicated by numeral 80, which will be discussed later in more detail. The output of op-amp 56 is delivered by the logic means to the input of a high temperature timer 82, the function and construction of which will also be discussed below.

Power is supplied to the circuit by means of a power supply comprising transformer 84 whose primary is coupled by line 24 to a suitable source of AC voltage, such as outlet 30. The power supply also includes a full wave bridge rectifier 86 coupled to the secondary of transformer 84, and regulators 88 and 90 which provide a regulated supply of DC voltage at terminals 92 and 94 respectively. The green indicator light 30 is coupled between the positive voltage output of regulator 88 and ground, thus, it may be appreciated that light 30 is illuminated when a proper supply of voltage is output from the power supply. In lieu of the power supply described above, a conventional battery may be employed to provide a suitable d.c. voltage source.

Switch 36 is a conventional three pole, double throw switch of a type being spring loaded to its center position. Switch 36 includes a first wiper **36*a* which selectively couples positive voltage with the inputs of op-amps 52–56 via line 96. A second wiper 36*b* selects a different output of the low temperature timer corresponding to an abnormal state and delivers it to the latch 98. The third wiper 36*c* selects a different output from the high temperature timer corresponding to another abnormal state and delivers it to the reset input of latch 98**.

Assuming now that potentiometers 58 and 60 are set at voltage levels corresponding to the upper and lower temperatures between which creosote forms on the flue lining 12, and further assuming that the thermocouple 20 senses a temperature within such range, the output of comparator 52 is high and the output of comparator 54 is low. The low output of comparator 54 is inverted by inverter 64 and the resulting output is delivered to one input of NAND gate 68, the other input thereto being formed by the high signal output from comparator 52. Thus, the output of NAND gate 68 goes low and such low is delivered to one input of NOR gate 70, the other input thereto being formed by an oscillator output at terminal 104. NAND gates 76 and 78 comprise the oscillator or "clock" as previously described.

The low output from NAND gate 68 enables the clock pulses to be delivered to NOR gate 70, thence to the clock input of the low temperature timer 80. Low temperature timer 80 may comprise a pair of integrated chips such as a CD 4040 which is a conventional digital pulse counter. Consequently, the low temperature timer 80 functions as a counter which counts the number of clock pulses delivered through NOR gate 70. The low temperature timer 80 is programmed such that it outputs a signal on terminal Q20 to the latch 98 when its count reaches a value corresponding to a condition in which the accumulation of creosote on the lining 12 has reached an unacceptably high level. The high output signal from timer 80 sets latch 98 which produces a high output signal from NOR gate 102 on line 106. The high signal on line 106 renders transistor 108 conductive thereby connecting the yellow light 32 between the power source and ground.

The output on Q20 remains high, and yellow light 32 remains illuminated until a reset signal is produced on line 115 by the high temperature timer 82 as will be discussed below. Timer 80 is initially reset when the power to the circuit is turned on by an R/C network comprising resistors 111, 113, 115 and capacitor 117 which are coupled with the power supply at terminal 119. It should be noted here that the low temperature timer 80 maintains a cumulative count over a period of time such that each time the stove 16 is used, a corresponding count is added to the existing count until the preselected count value has been reached. Thus, it may be appreciated that the cumulative count held by the low temperature timer 80 is always directly proportional to the magnitude of creosote accumulation on the liner 12. It may be further appreciated that timer 80 does not accumulate counts when the stove 14 is off, i.e., when the temperature in the flue 14 is below the normal operating range thereof. Those skilled in the art will recognize that the number of clock pulses i.e. time period required to produce a high output signal on Q20 may be conveniently altered by selecting different output terminals of timer 80 or by employing differing frequencies for the clock.

When the temperature sensed by the temperature sensor 20 is sufficient to result in combustion of the accumulated creosote on the flue lining 12 the output of comparator 56 goes high thereby turning on transistor 110 to illuminate the red light 34. The high output from comparator 56 also enables NAND gate 72 to pass through clock pulses from the oscillator output 104 to the clock input of high temperature timer 82. High temperature timer 82 may comprise a counter such as an integrated circuit CD 4020. Clock pulses are therefore counted by the high temperature timer for the duration during which the temperature within flue 14 remains at a level sufficient to ignite the accumulated cresote. When the high temperature timer 82 reaches a predetermined count, corresponding to the point in time that substantially all of the accumulated creosote has been combusted, a high output signal is delivered on terminal Q13 to the reset input of the low temperature timer 80 as well as to the reset input of latch 98; thus, timer 80 and latch 98 are reset, thereby deenergizing the yellow light 32. Again, it will be appreciated by those skilled in the art that the count at which the high temperature timer produces the reset pulse may be conveniently varied either by alteration of the clock frequency or selection of alternate output terminals of timer 82.

In the event that the flue temperature drops below the value required to combust the accumulated creosote prior to the high temperature timer achieving a full count, the resulting low output of comparator 56 is delivered through NOR gate 74 to an RC network comprising capacitor 112, and resistors 114 and 116. The RC network delivers a reset pulse to the high temperature timer, causing the later to be reset. In this manner, the low temperature time 80 and yellow light 32 are prevented from being prematurely reset, prior to the time that substantially the entire accumulation of creosote is removed from the flue lining 12.

As previously indicated, the test switch 36 permits testing of the various components and lights 30–34. When switch 36 is in the yellow test position 42, a voltage corresponding to a normal burn temperature is delivered to comparators 52 and 54 thus simulating a normal burning condition. The resulting signals output by comparators 52 and 54 enable the low temperature timer 80, and latch 98 is set by an output pulse delivered on terminal $Q_N$ of timer 80 through wiper **36*b*. The yellow light 32 remains on until shortly after switch 36 is shifted to the red test position 44**.

With switch 36 in red test position 44, a voltage is delivered via line 96 to the input of comparators 52–56; the value of this voltage is, as a result of a voltage divider generally indicated at 118, greater in magnitude than that corresponding to the minimum temperature for combusting the accumulated creosote. The voltage value on line 96 causes the output of comparator 56 to go high which in turn illuminates the red light 34. Wiper **36*c* also couples the $Q_N$ output terminal of high temperature timer 82 with the reset input of latch 98. Consequently, the high output signal from comparator 56 results in an output on terminal $Q_N$ from timer 82 which resets latch 98 and extinguishes the yellow light 32. The red light 34 is deenergized shortly after the switch 36 is toggled back to its operate position 40**.

From the foregoing, it can be appreciated that a novel method of monitoring the accumulation of unburned particulates, such as creosotes, on the flue lining of a combustion device is provided which includes the steps of sensing the temperature within the flue lining, measuring the time only during which the sensed temperature is within a first temperature range in which particulates accumulate on the flue lining and automatically providing a warning of the point when the measured time reaches a preselected value. The method of the invention also includes the steps of measuring the time during which the sensed temperature exceeds a value which is sufficient to result in combustion of the accumulated particulates and automatically providing an indication of when the last mentioned time measurement is sufficient to result in substantially complete combustion of the accumulated particulates. It is apparent that the time measurement mentioned above is performed by producing an electrical analog signal whose magnitude varies in accordance with the sensed temperature, and using such analog signal to control the accumulated count of the pulses.

Figures 2A, 3:
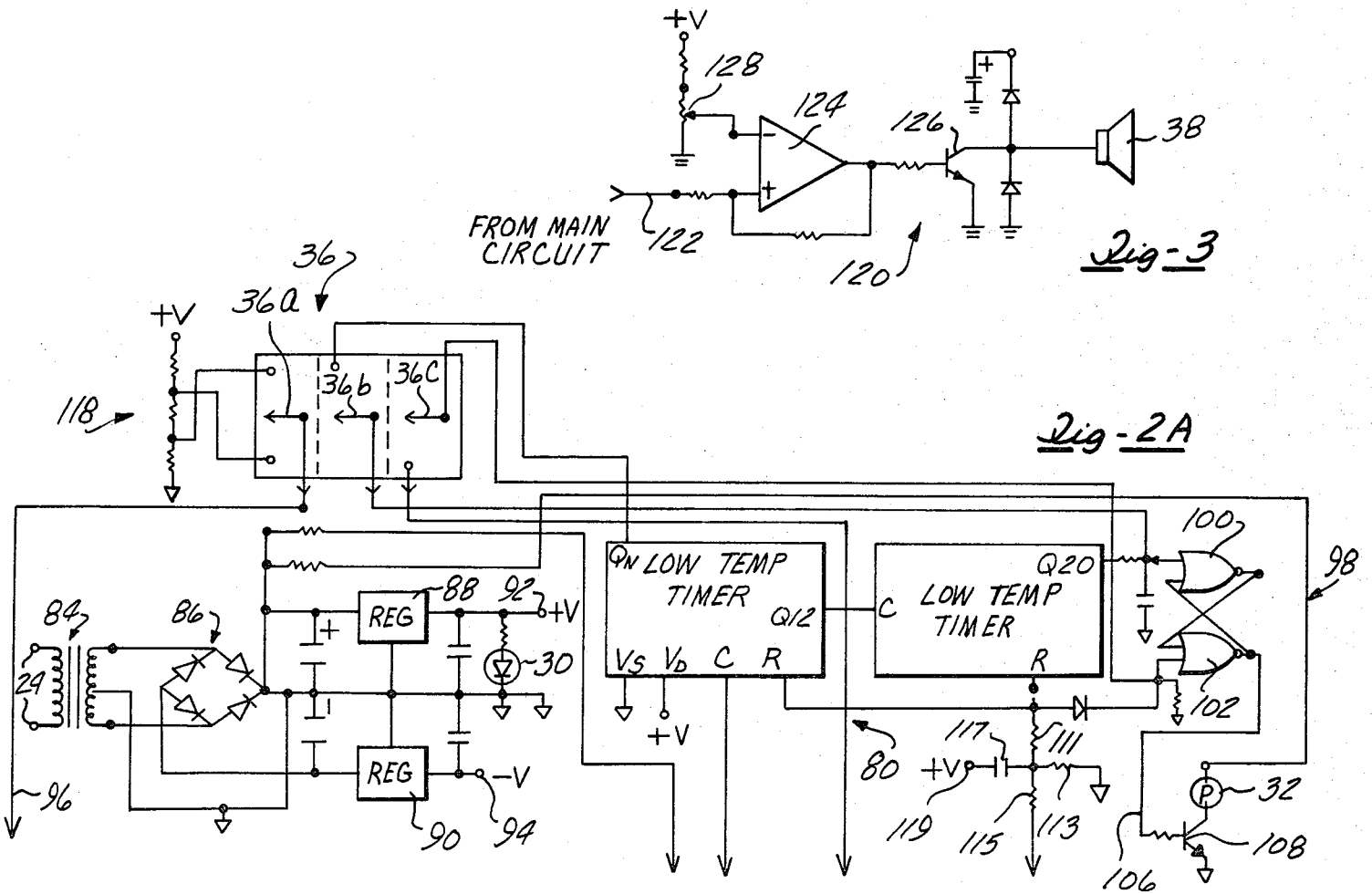
FIGS. 2*a* and 2*b*, taken together, form a detailed schematic diagram of the circuit for the monitoring apparatus; and, FIG. 3 is detailed schematic diagram of an optional alarm circuit for use with the circuit shown in FIGS. 2*a* and 2*b*.
Figure 2B:
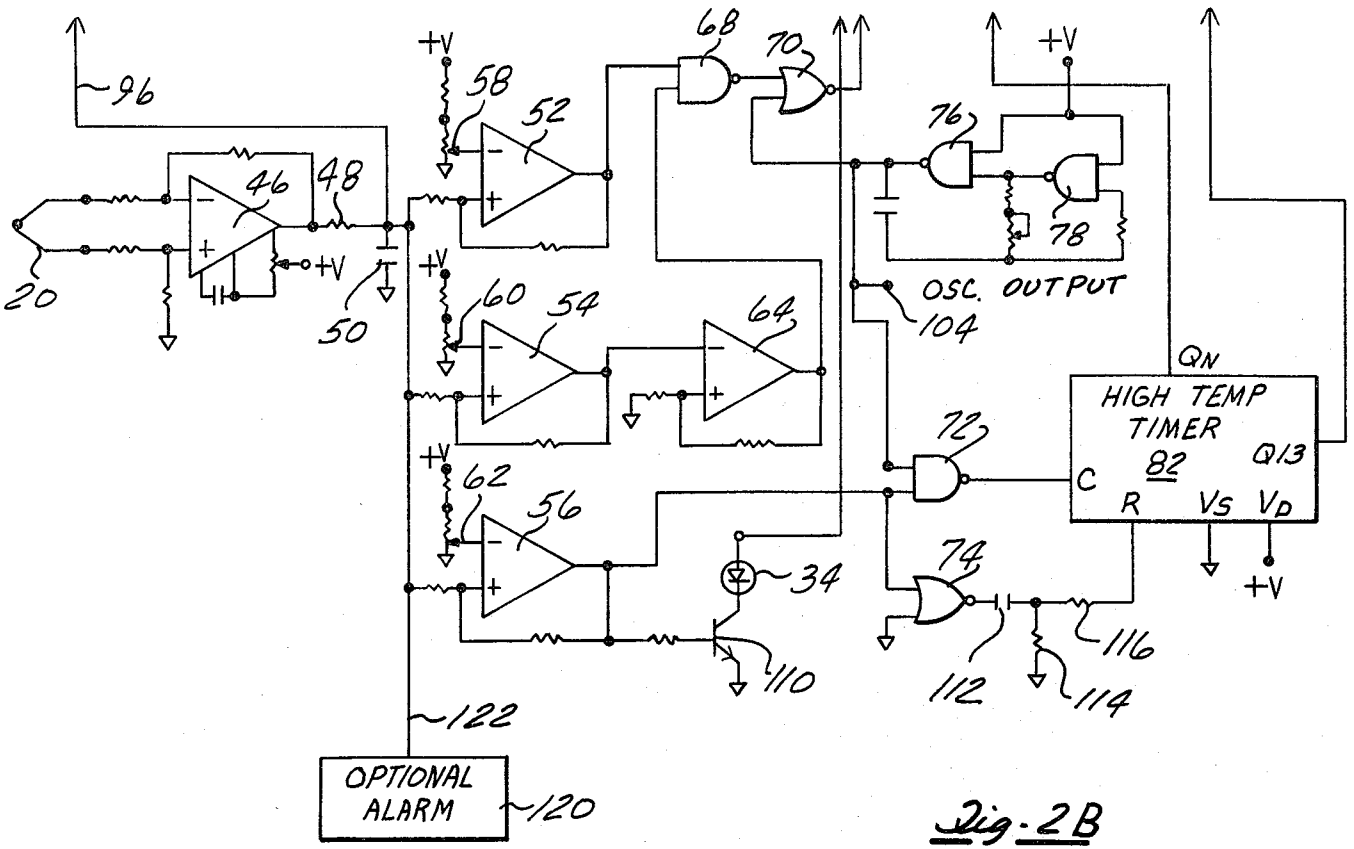

Referring also now to FIG. 3, an optional alarm 120 may be employed for providing an indication when the temperature within the flue 14 reaches a dangerously high level which presents a risk of fire. The alarm 120 includes an input line 122 coupled with the output of amplifier 46 so as to receive the temperature dependent signal from thermocouple 20. Alarm 120 further includes a comparator 124 whose negative input is connected to a potentiometer 128, the positive input thereof being connected to input line 122. When the magnitude of the input signal on line 122 exceeds the value preset on potentiometer 128, the output of comparator 124 goes high thereby turning on transistor 126 which energizes the horn 38.

From the foregoing, it may be appreciated that a novel apparatus and method for monitoring unburned particulate accumulation within an exhaust duct of a combustion system are provided which not only provides for the reliable accomplishment of the objects of the invention but does so in a particularly effective and reliable manner. It is to be understood that the terms flue, flue lining and exhaust duct as used herein are intended to refer to any area, duct, pipe, system or structure into or through which exhaust gases from a combustion process may pass. It is recognized, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

We claim:

1. Apparatus for monitoring particulate accumulation within an exhaust associated with a stove or the like, comprising:

means for sensing the temperature within said exhaust;

means for generating a count corresponding to the duration of time that said temperature is within a first temperature range wherein particulates accumulate within said exhaust; and means responsive to said count generating means for producing an indication of when the count reaches a preselected value corresponding to a prescribed accumulation of particulates within said exhaust.

2. The apparatus of claim 1, including first means for resetting said count generating means when said temperature is maintained within a second temperature range for a preselected time interval.

3. The apparatus of claim 2, wherein said first resetting means includes means for producing a count corresponding to duration for which said temperature is maintained within said second temperature range.

4. The apparatus of claim 3, wherein said first resetting means includes second means for resetting said first resetting means when said temperature falls below said second temperature range.

5. The apparatus of claim 3, wherein said count generating means and said count producing means each includes a counter device for counting digital pulses.

6. The apparatus of claim 2, including:

means for converting the temperature sensed by said sensing means to an electrical signal the magnitude of which is proportional to said temperature; and means coupled with said converting means for sensing the magnitude of said signal.

7. The apparatus of claim 6, wherein said means for sensing the magnitude of said signal includes a plurality of comparator devices each having a first input for receiving said signal, a second input for establishing a reference signal value and an output for delivering an output signal when the magnitude of said electrical signal and said reference value are in a preselected relationship to each other.

8. The apparatus of claim 7, wherein said count generating means includes:

means for generating clock pulses and logic gate means coupled with the output of said comparator devices for gating said clock pulses in accordance with said output signals.

9. Apparatus for monitoring the accumulation of particulates on the lining of an exhaust duct or the like associated with a combustion device, comprising:

means for sensing the temperature within the duct including means for converting the sensed temperature to an electrical signal proportional in magnitude to said temperature;

means for detecting when the magnitude of said signal is within first and second ranges respectively corresponding to first and second flue temperature ranges;

first means responsive to said detecting means for generating a count corresponding to the time interval that the magnitude of said signal is within said firstrange thereof;

means responsive to said first means for providing a perceivable indication of when said count reaches a prescribed value, said prescribed value being proportional to an accumulation of particulates on said duct;

second means responsive to said detecting means for generating a count corresponding to the time interval that the magnitude of said signal is within said second range thereof; and, means controlled by said second means for resetting the count of said first means when the count of said second means reaches a preselected value.

10. The apparatus of claim 9, wherein said temperature converting means includes a thermocouple device and an amplifier coupled with said thermocouple device.

11. The apparatus of claim 9, wherein said detecting means includes a plurality of electrical comparators each having an output and operable for comparing the magnitude of said signal with respectively associated reference values.

12. The apparatus of claim 11, including means for converting the signals on the outputs of said comparators to digital pulses.

13. The apparatus of claim 12, wherein said converting means includes logic gate means and means coupled with said logic gate means for producing clock pulse signals.

14. The apparatus of claim 12, wherein said first and second means each include a digital counter for receiving said digital pulses from said converting means.

15. The apparatus of claim 14, wherein said resetting means includes:

a reset input on the counter associated with said first means, an output on the counter associated with said second means for delivering an output signal when the count of said second means reaches said preselected value thereof, and means for delivering said output signal to said reset input.

16. The apparatus of claim 9, including means responsive to said second means for providing a perceivable indication of when the count of said second means reaches said preselected value thereof.

17. The apparatus of claim 15, wherein:

the counter associated with said first means includes an output for delivering a signal when the corresponding count reaches said prescribed value thereof, and said means for providing a perceivable indication includes an electrically responsive visual device and a latch coupled between said visual device and said output.

18. The apparatus of claim 9, including means coupled with said temperature sensing means for detecting when the magnitude of said signal exceeds an alarm level greater than said first and second ranges thereof, and means responsive to said last named detecting means for activating an alarm when said signal reaches alarm level thereof.

19. A method of monitoring the accumulation of unburned particulates within an exhaust device associated with a combustor, such as the flue lining of a stove flue, comprising the steps of:

(A) sensing the temperature within said flue lining;

(B) measuring the time during which the sensed temperature is within a first temperature range in which particulates accumulate on said flue lining; and (C) automatically providing a perceivable warning when the measured time reaches a preselected value.

20. The method of claim 19, including the steps of:

(D) measuring the time during which the sensed temperature exceeds a value which is sufficient to result in combustion of the accumulated particulates; and (E) automatically providing a perceivable indication when the time measured in step (D) is sufficient to result in substantially complete combustion of the accumulated particulates.

21. The method of claim 19, wherein step (B) is performed by producing an electrical analog signal whose magnitude varies in accordance with the sensed temperature, producing a count using said analog signal, and accumulating said count.

22. A method of monitoring the accumulation of unburned particulates within the exhaust system of a combustion device, comprising the steps of:

(A) sensing the temperature within said exhaust system;

(B) converting the temperature sensed in step (A) to an electrical signal which varies in magnitude in accordance with changes in said temperature;

(C) measuring the level of said electrical signal;

(D) producing digital pulses when the magnitude of said electrical signal falls within either first or second ranges;

(E) accumulating a count of the number of digital pulses when said signal is within said first range thereof;

(F) activating a warning device when the count accumulated in step (E) reaches a preselected value;

(G) accumulating a count of the number of digital pulses when said signal is within said second range thereof;

(H) releasing the count accumulated in step (E) when the count accumulated in step (G) reaches a prescribed value.

23. The method of claim 22, wherein step (C) is performed by comparing the magnitude of said signal with a plurality of differing reference values.

24. Apparatus for monitoring the accumulation of particulates on the lining of an exhaust duct or the like for a combustion device, comprising:

means for sensing the temperature within said exhaust duct;

means for generating an electrical signal correlated to the duration of time that said temperature is within a first temperature range wherein particulates accumulate on said lining; and means coupled with said generating means for producing an indication of when said electrical signal reaches a preselected value corresponding to a prescribed accumulation of particulates on said lining.

25. The apparatus of claim 24, wherein said generating means includes:

means for developing a digital count corresponding to the duration of time said temperature is within said first temperature range, and means for accumulating said count.

* * * * *

UNITED STATES PATENT AND TRADEMARK OFFICE

CERTIFICATE OF CORRECTION

PATENT NO. : 4,378,555

DATED : Mar. 29, 1983

INVENTOR(S) : Thomas A. Johnson et al.

It is certified that error appears in the above-identified patent and that said Letters Patent are hereby corrected as shown below:

Column 2, line 15, delete "mgnitude" and insert --magnitude--.

Column 2, line 46, delete "FIG. 3 is detailed" and insert --FIG. 3 is a detailed--.

Column 4, line 63, delete "of" and insert --to--.

Column 8, line 39, delete "firstrange" and insert -- first range--.

Signed and Sealed this

*Nineteenth* Day of *July 1983*

[SEAL]

*Attest:*

GERALD J. MOSSINGHOFF

*Attesting Officer*

*Commissioner of Patents and Trademarks*